United States Patent [19]

Kunitz et al.

[11] 4,322,492

[45] Mar. 30, 1982

[54] PROCESS FOR THE DEVELOPMENT OF COLOR PHOTOGRAPHIC IMAGES WITH P-DIALKYLAMINOANILINE COLOR DEVELOPERS

[75] Inventors: Friedrich-Wilhelm Kunitz; Walter Püschel, both of Leverkusen; Karl W. Schranz, Odenthal-Hahnenberg, all of Fed. Rep. of Germany

[73] Assignee: AGFA-Gevaert Aktiengesellschaft, Leverkusen, Fed. Rep. of Germany

[21] Appl. No.: 256,958

[22] Filed: Apr. 23, 1981

Related U.S. Application Data

[63] Continuation of Ser. No. 780,129, Mar. 22, 1977, abandoned.

[30] Foreign Application Priority Data

Mar. 27, 1976 [DE] Fed. Rep. of Germany ..... 2613120

[51] Int. Cl.[3] ..... G03C 5/30

[52] U.S. Cl. ..... 430/375; 430/435; 430/442; 430/467; 430/484

[58] Field of Search ..... 430/375, 435, 442, 467, 430/468, 469, 484

[56] References Cited

U.S. PATENT DOCUMENTS

| | | | |
|---|---|---|---|
| 2,603,656 | 7/1952 | Martin | 96/66 R |
| 2,716,132 | 8/1955 | Martin | 96/66 R |
| 3,723,117 | 3/1973 | Willems | 96/66 R |
| 3,920,739 | 11/1975 | Suda et al. | 96/66 R |

FOREIGN PATENT DOCUMENTS

| | | | |
|---|---|---|---|
| 576424 | 5/1959 | Canada | 96/66 R |
| 7593 | 2/1980 | European Pat. Off. | 430/468 |
| 811679 | 4/1959 | United Kingdom . | |

*Primary Examiner*—Mary F. Downey
*Attorney, Agent, or Firm*—Connolly and Hutz

[57] ABSTRACT

The process for the development of color photographic images with an aqueous alkaline color developer mixture comprising methyl-p-dialkylaminoaniline derivates. The process provides brilliant color photographic images avoiding coloration of the support and color fog even when processing at high temperatures.

4 Claims, No Drawings

PROCESS FOR THE DEVELOPMENT OF COLOR PHOTOGRAPHIC IMAGES WITH P-DIALKYLAMINOANILINE COLOR DEVELOPERS

CROSS REFERENCE

This application is a continuation of application Ser. No. 780,129 filed Mar. 22, 1977 by Friedrich-Wilhelm Kunitz et al for "Process For The Development Of Colour Photographic Images With P-Dialkyl-Aminoaniline Colour" (now abandoned).

This invention relates to a colour photographic development process in which development of exposed silver halide in photographic layers takes place in the presence of methyl-p-dialkylaminoaniline derivatives, and to a colour photographic developer containing a methyl-p-dialkylaminoaniline derivative.

It is known that p-dialkylaminoaniline derivatives can be used as developer substances for the production of photographic images. The best known colour developers are derived from p-dialkylaminoanilines which are either methyl substituted in the aromatic ring or which contain alkylsulphoalkyl, alkylsulphonamido or acid groups such as sulpho groups, or ether or hydroxyl groups in the alkylamino group. It has been found that if photographically the most favourable results are to be obtained with regard to the development time required, the absorption of the dyes produced and the behaviour of the residual colour developer in the photographic layers, the colour developer used must be adapted to the conditions of the development process according to the solubility and nature of the colour couplers used in the photographic materials.

Particularly stringent demands must be satisfied by colour developer substances which are used in special photographic processes in which they are not or only incompletely removed from the photographic material by washing. They must not give rise to any side reactions such as, for example, formation of unwanted colour fog. Other requirements which must be taken into account when selecting suitable developer compounds have been discussed in some detail in German Patent No. 965,617.

Another factor which is of considerable importance in the selection of suitable developer compounds is the processing temperature employed for the desired development process. Thus, for example, a colour developer may develop a multilayered material to a completely neutral colour reproduction at a processing temperature of 20° C. but at 28° C. give rise to difficulties which cannot be overcome by changes in pH or changes in the composition of the developer. At this higher processing temperature, the colour developer compound has a greater capacity for diffusion and hence causes falsification of colour due to partial development of adjacent layers.

There is, therefore, a demand for new, readily available colour developer subtances which can be used not only for development of multilayered colour photographic materials at room temperature but also for processing at higher temperatures.

It has now been found that this problem is solved by using methyl-p-dialkylaminoaniline derivatives of the formula:

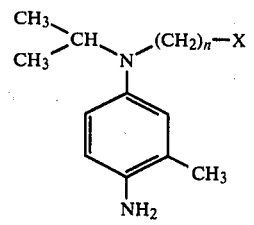

wherein

X denotes hydroxyl, methoxy, sulphophenoxy or sulpho; and n represents an integer of from 2 to 4.

X is preferably a sulpho group when n is 4.

The developers may be used in the form of their free bases or in the form of their water-soluble salts, e.g. salts of inorganic or organic acids such as sulphuric acid or p-toluenesulphonic acid.

Due to the presence of the isopropyl group in the dialkylamino group, the colour developers used according to the invention have the following advantages over analogous compounds in which the alkyl group is unbranched: The dyes produced by the colour developers have excellent absorption maxima. When the developers are compared with p-N-propylalkylaminoaniline developers, it is found that the absorption of the yellow dye formed with a yellow colour coupler is distinctly shifted to shorter wavelengths, a characteristic which is particularly advantageous in yellow colour couplers, for example benzoyl acetanilide yellow couplers, which tend to form dyes with a relatively long wave adsorption maximum when they react with known colour developers.

As compared with the developers according to German Pat. No. 965,617, the analogous developers according to the present invention are unexpectedly found not to colour polyethylene-laminated or baryta-treated paper supports even if the developer already shows considerable signs of decomposition due to having been left exposed to air. There is also a reduction in the colour fog which forms when a photographic material is simply squeezed dry after development instead of being rinsed before it is transferred into a bleach fixing bath. This effect is all the more surprising since an isobutyl group in place of the isopropyl group according to the invention does not have this effect of reducing the dye adsorption or tendency to coloration of the usual paper supports.

Like the compounds according to German Pat. No. 965,617, the developers according to the invention are completely non-toxic and excellent in all their other properties as developer substances for the usual multilayered colour photographic materials.

In addition, by virtue of their isopropyl group, they have the advantage that they can be used for development both at normal temperature and at elevated temperatures. Furthermore, due to their low tendency to give rise to colour fog, they are particularly suitable for development in rapid processes in which the materials are not rinsed between development and bleach fixing.

Such processes have been described, for example, in German Pat. No. 1,155,980 and in German Offenlegungsschrift No. 2 160 872.

The present invention thus provides an aqueous alkaline colour developer mixture containing a colour developer of the methyl-p-dialkylaminoaniline series, characterised in that it contains, as colour developer, a compound of the formula:

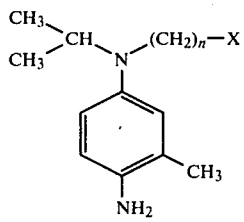

or water-soluble salts thereof, wherein X and n have the meaning indicated above.

The invention also provides a process for the development of colour photographic images based on silver halide materials using an aqueous alkaline colour developer mixture in the presence of a colour developer of the methyl-p-dialkylaminoaniline series having the structure indicated above.

The developer substances may be prepared by known methods, for example by the method described in German Pat. No. 965,617 in which p-nitro-m-methyl-N-isopropylaniline is reacted with sultones to form p-nitro-m-methyl-N-isopropyl-N-sulphoalkylaniline, which is then reduced to the diamine in conventional manner.

Another method of preparation is described in detail below:

1st Stage 734.4 g of 2-bromopropane are added dropwise to a solution of 642 g of m-toluidine in 642 ml of anhydrous dimethylformamide at a reaction temperature of 120° C. with stirring. The mixture is then left to react for a further 2 hours at 130° C. After removal of dimethylformamide by distillation in a water jet vacuum, the residue is dissolved hot in 1000 ml of water, cooled with ice, and made strongly alkaline by the addition of about 900 ml of 5 N sodium hydroxide solution.

The oil which separates is extracted with 1.5 l of ether in a separating funnel and the ether layer is washed four times with 750 ml portions of water. After removal of the ether by distillation, the oil is fractionally distilled twice. The fraction obtained at a boiling point of 64°-66° C. and a vacuum of 0.25 Torr is used for subsequent reaction (yield 492 g).

2nd Stage 447.6 g of N-isopropyl-m-toluidine prepared as described in Stage 1 are dissolved in 480 ml of xylene.

416.1 g of 1,4-butanesultone are added dropwise at a temperature of 100° C. with stirring. The reaction mixture is then heated to a temperature of 140° C. and stirred at this temperature for 2 hours.

1.7 l of acetone are then carefully added to the reaction solution at boiling point and the precipitate which forms is suction filtered and washed with acetone (yield 580 g).

3rd Stage 571 g of N-isopropyl-N-[ω-sulphobutyl]-n-toluidine obtained in Stage 2 are introduced into a mixture of 1000 ml of water and 280 ml of concentrated sulphuric acid at about 80° C. with stirring. The resulting solution is cooled to −10° C. and a solution of 142 g of sodium nitrite in 250 ml of water is added dropwise at a temperature of between −10° C. and 0° C.

656 g of sodium acetate are added after 30 minutes' stirring at the above temperature.

5.5 l of acetone are then added to the reaction mixture with stirring. The resulting precipitate (sodium sulfate and the N-isopropyl-[ω-sulphobutyl-]-4-nitroso-3-methylaniline) is suction filtered after one hour and washed with acetone (yield 1130 g).

4th Stage 932 g of the mixture of N-isopropyl-[ω-sulphobutyl]-4-nitroso-3-methylaniline and sodium sulphate obtained in Stage 3 are suspended in 1 l of isopropanol and adjusted to pH 8 with 100 ml of 20% ammonia solution. After removal of the undissolved salt by suction filtration, the filtrate is made up to a volume of 1900 ml with isopropanol and the resulting solution is catalytically hydrogenated under a pressure of 50 atmospheres guage and at a temperature of 20° to 50° C., using neutral Raney Nickel. After suction filtration from the hot catalyst the reaction mixture is evaporated to dryness under vacuum after the addition of 91 ml of glacial acetic acid. The residue obtained is boiled with isopropanol, filtered off and washed with isopropanol (yield 225 g of N-isopropyl-[ω-sulphobutyl]-4-amino-2-methylaniline).

Developer solutions prepared with the substances according to the invention contain the usual developer constituents, namely a substance which is alkaline in reaction such as soda, potash, trisodium phosphate or the like, a substance which retards development such as potassium bromide, an antioxidant such as sodium sulfite or hydroxylamine, and a buffer. It may also contain other additives such as complex-forming compounds, hardeners, antifogging agents, hydroxylamine protective substances, such as hydroxyethylidene diphosphonic acid, etc.

The colour developing substance may also be combined with other known black-and-white and with colour developer substances. The coupler required for development may be situated in the photographic layer, for example it may be incorporated there in a diffusion-resistant form, or it may be present in the colour developer solution itself.

The following are examples of compounds which are suitable for use as developer substances according to the invention:

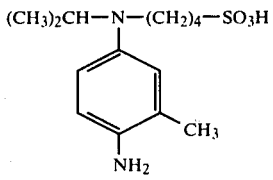

(1)

-continued

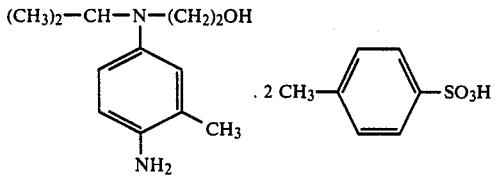

(2)

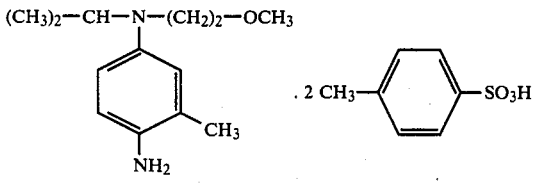

(3)

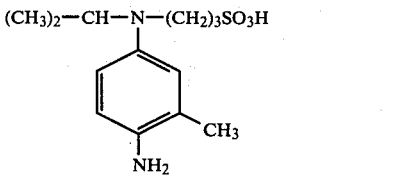

(4)

EXAMPLE 1

This Example investigates the behaviour of colour developers which contain oxidized colour developer products on polyethylene-laminated paper supports which originally are covered with a silver halide emulsion layer suited for black-and-white photographic material.

For this purpose, a conventional black-and-white photograhic paper mounted on a polyethylene-laminated paper support is completely freed from silver halide in a fixing bath and dried.

The fixed paper is then cut up into several samples and each sample is dipped for 5 minutes in one of the developers described below.

Each of the samples is then rinsed in water for one minute and dried.

The developers contained the following substances:

50 g of potassium carbonate.

2 g of tetrasodium ethylene diaminotetraacetate, and 4 g of one of the developer substances indicated below, per liter of water. The developers were left to stand in an open vessel for one day before use. The following developer substances were used:

1. 4-Amino-3-methyl-N-ethyl-N-methanesulphonamidoethylaniline
2. 4-Amino-3-methyl-N-butyl-N-δ-sulphobutylaniline
3. 4-Amino-3-methyl-N-ethyl-N-δ-sulphobutylaniline
4. 4-Amino-3-methyl-N-isopropyl-N-δ-sulphobutylaniline
5. 3-Amino-3-methyl-N-ethyl-N-γ-sulphopropylaniline
6. 4-Amino-3-methyl-N-n-butyl-N-γ-sulphopropylaniline
7. 4-Amino-3-methyl-N-n-propyl-N-γ-sulphopropylaniline.

On comparing the samples obtained it is found that developer 4, containing the developer substance according to the invention, produces virtually no coloration of the gelatine layer visible to the naked eye, whereas developers 1, 3 and 6 each cause a slight yellowish coloration, developer 7 causes a more pronounced, slightly reddish coloration, developer 2 gives rise to a pronounced brown coloration and developer 6 to a marked reddish brown coloration.

EXAMPLE 2

This Example investigates the behaviour of colour developers which are left in colour photographic materials after development owing to insufficient rinsing and which are therefore liable to cause an undesirable colour fog in the subsequent treatment in a bleach fixing bath.

For this purpose there is used a colour photographic material having a polyethylene-laminated paper support on which are arranged 1. a blue-sensitive silver halide emulsion layer containing a yellow coupler,
2. a green-sensitive silver halide emulsion layer containing a magenta coupler, and
3. a red-sensitive silver halide emulsion layer containing a cyan coupler.

The material was completely fixed in a conventional black-and-white fixing bath, rinsed and cut up into several samples when dry.

The samples were then treated as follows:

They were dipped for one minute in one of the colour developers indicated below at 22° C., and without further preparation they were dipped for one second in a bleach fixing bath at 22° C.

The reaction solution was then stripped off and, after 5 minutes' treatment in air at 22° C., the samples were rinsed for 10 minutes and dried.

The following colour developers were used:

| | |
|---|---|
| Developer 1 | |
| Sodium salt of nitrilotriacetic acid | 2 g |
| 2-Hydroxyethylidene diphosphonic acid in the form of the sodium salt | 1 g |
| Hydroxylamine sulphate | 3 g |
| Sodium sulphite | 3 g |
| Potassium bromide | 0.3 g |
| Potassium carbonate | 60 g |
| 4-Amino-3-methyl-N-ethyl-N-methane sulphonamidoethylaniline | 4 g |
| Water up to one liter. | |
| Developer 2 | |
| 2-Hydroxyethylenediphosphonic acid in the form of its sodium salt | 1 g |
| Potassium bromide | 0.25 g |
| Hydroxylamine sulphate | 3.3 g |
| Potassium carbonate | 33 g |
| Sodium sulphite | 1.6 g |
| Lithium sulphate | 2 g |
| Benzyl alcohol | 13.5 ml |
| 4-Amino-3-methyl-N-ethyl-N-methane sulphonamido ethyl aniline | 4 g |
| Water up to one liter | |
| pH | 10.3 |
| Developer 3 | |
| Sodium salt of nitrilotriacetic acid | 3 g |
| Hydroxylamine sulphate | 3 g |
| Sodium sulphite | 3 g |
| Potassium bromide | 0.4 g |
| Potassium carbonate | 35 g |
| 4-Amino--3-methyl-N-isopropyl-N-δ-sulfobutylaniline | 5 g |
| Water up to one liter. | |
| Developer 4 | |
| Hydroxylamine sulphate | 2 g |
| Potassium carbonate | 75 g |
| Potassium bromide | 1 g |
| Sodium sulphite | 2.5 g |
| Sodium salt of nitrilotriacetic acid | 2 g |
| 2-Hydroxyethylidene diphosphonic acid as sodium salt | 2 g |

-continued

| | |
|---|---|
| N-butyl-N-δ-sulphobutyl-p-phenylenediamine | 5 g |
| Water up to one liter. | |

A bleach fixing bath of the following composition was used:

| | |
|---|---|
| Sodium salt of ethylene diaminotetracetic acid | 15 g |
| Iron-(III)complex of ethylenediamino-tetracetic acid in the form of its sodium salt | 40 g |
| Sodium sulphite | 8 g |
| Ammonium thiosulphate | 100 g |
| Water up to one liter | |
| pH | 7.2 |
| adjusted with soda solution. | |

The photographic material contained the following coupler compounds:

Material A

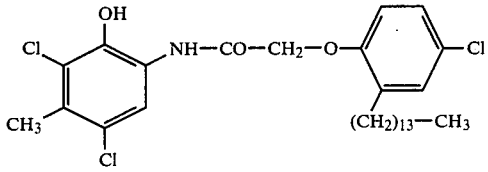

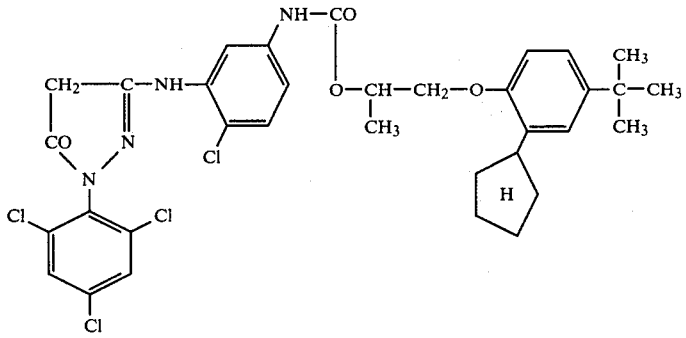

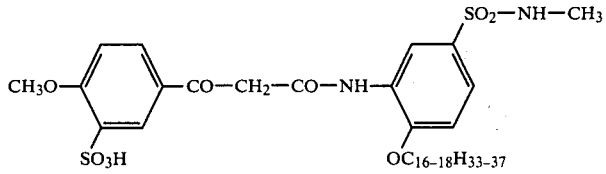

A second colour photographic material B, analogous in its structure to that of Example A except that it contained a compound of the following formula as a yellow coupler, was processed in analogous manner:

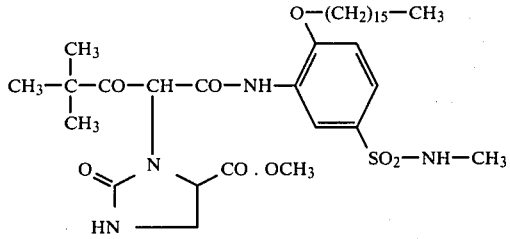

A third colour photographic material C, analogous in structure to material A except that it contained a compound of the following formula as a magenta coupler, was processed in analogous manner:

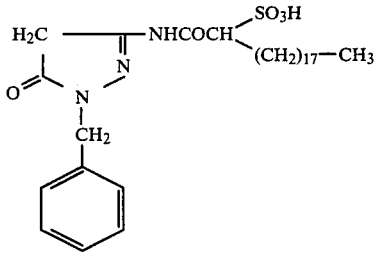

The colour fog formed in this treatment is a measure of the susceptibility of the residual colour developer to forming an increased colour fog at the bleach fixing stage when processed in conventional colour photographic materials if the residual colour developer has not been removed sufficiently from the photographic material.

The results obtained are summarised in the following

TABLE

| | Developer 1 Colour fog | | Developer 2 Colour fog | | Developer 3 Colour fog | | Developer 4 Colour fog | |
|---|---|---|---|---|---|---|---|---|
| Material | Yellow | Magenta | Yellow | Magenta | Yellow | Magenta | Yellow | Magenta |
| A | 0.06 | 0.03 | 0.16 | 0.11 | 0.02 | 0.01 | | |
| B | 0.03 | 0.03 | 0.07 | 0.08 | 0.01 | 0.0 | | |
| C | | | | | | | 0.16 | 0.26 |

EXAMPLE 3

A blue-sensitive silver chlorobromide emulsion containing one of the yellow colour couplers indicated below was cast on a transparent film support. When dry the photographic material obtained in this way was cut up into several samples. In each case a sample was assessed in a densitometer after exposure behind a graduated grey wedge and development by a conventional colour photographic process, using developers of the following composition:

Developer 1

Analogous to Developer 3 of Example 2 except that the developer substance used there was replaced by N-ethyl-N-$\beta$-oxyethyl-3-methyl-p-phenylendiamine.

Developer 2

Analogous to Developer 3 of Example 2 except that the developer substance used there was replaced by developer substance 2 according to the invention.

Developer 3

The same as Developer 3 of Example 2 except that the developer substance used there was replaced by 4-amino-3-methyl-N-butyl-N-$\delta$-sulphobutylaniline.

Developer 4

Analogous to Developer 3 of Example 2.

The emulsion contains the following coupler compound (I):

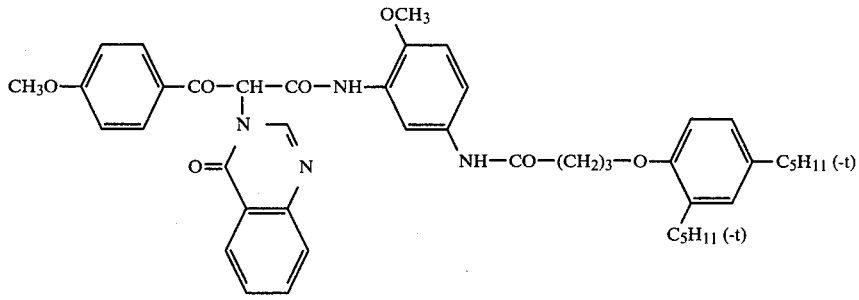

(I)

Photographic materials containing the following coupler compounds (II) to (X) were obtained in analogous manner:

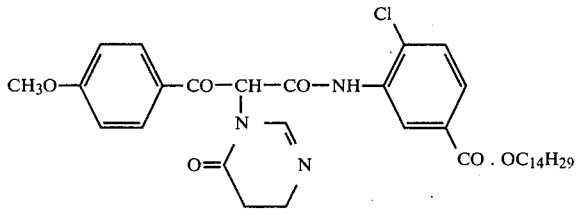

(II)

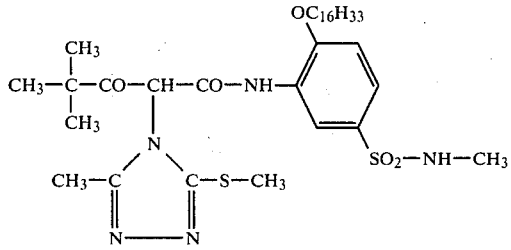

(III)

-continued
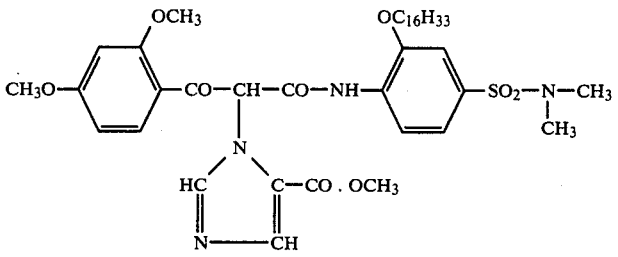
(IV)
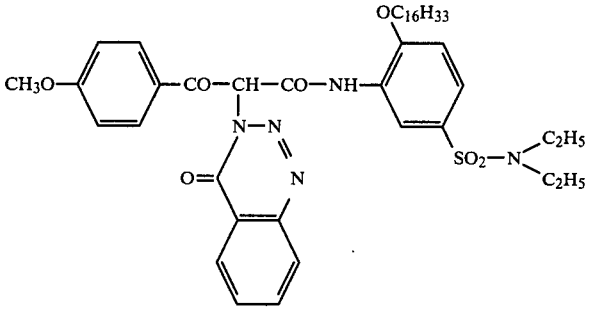
(V)
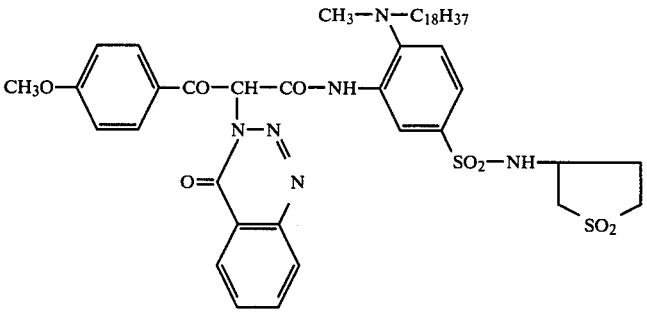
(VI)
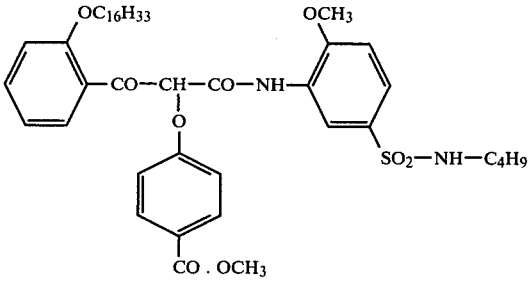
(VII)
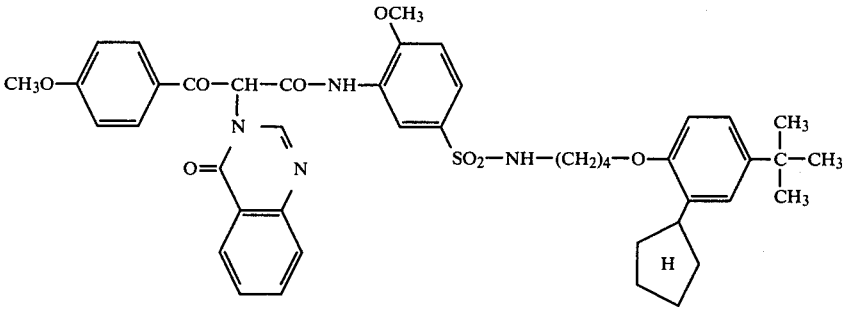
(VIII)

-continued (IX)

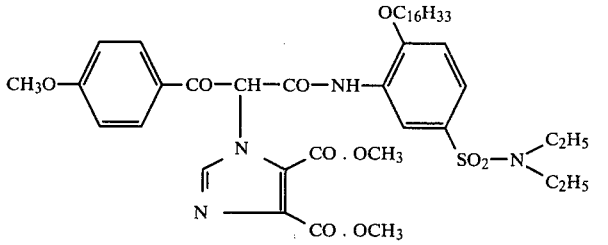

(X)

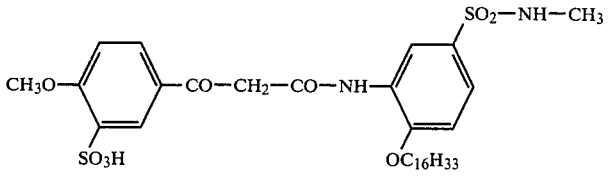

The sensitometric examination shows that colour developers 2 and 4 according to the invention develop into very brilliant pure yellow dyes which have the following maxima given in nm:

| Coupler compound | Developer 1 | 2 | 3 | 4 |
|---|---|---|---|---|
| I | 447 | 442 | 444 | 446 |
| II | 449 | 448 | 451 | 453 |
| III | 438 | 438 | 443 | 442 |
| IV | 450 | 449 | 452 | 451 |
| V | 451 | 448 | 452 | 453 |
| VI | 445 | 443 | 451 | 448 |
| VII | 440 | 436 | 445 | 440 |
| VIII | 422 | 422 | 434 | 435 |
| IX | 453 | 449 | 453 | 451 |
| X | 454 | 450 | 455 | 452 |

We claim:

1. An aqueous alkaline colour developer composition for the development of colour photographic materials based on silver halide, and composition containing a colour developer of the methyl-p-dialkylaminoaniline series, wherein the improvement comprises the colour developer used is a compound of the formula:

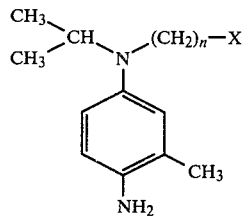

or water-soluble salts thereof, wherein

X represents hydroxyl, methoxy or sulpho, and n represents an integer of from 2 to 4.

2. A colour developer composition according to claim 1, characterised in that X represents a sulpho group and n represents 4.

3. A process according to claim 1, characterised in that X represents a sulpho group and n=4.

4. A process of developing an imagewise exposed color photographic material with an aqueous alkaline color developer composition to form an image wherein the improvement comprises the step of developing the imagewise exposed colorphotographic material with a color developer including a compound of the formula

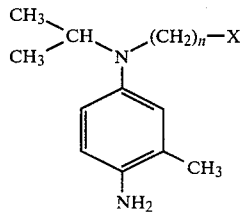

of water-soluble salts thereof, wherein

X represents hydroxyl, methoxy or sulpho, and n represents an integer of from 2 to 4.

* * * * *